US005628697A

United States Patent [19]

Gamble

[11] Patent Number: 5,628,697

[45] Date of Patent: May 13, 1997

[54] GOLF CLUB

[76] Inventor: Christopher L. Gamble, P.O. Box 9154, Canoga Park, Calif. 91309

[21] Appl. No.: 560,528

[22] Filed: Nov. 17, 1995

[51] Int. Cl.[6] ..... A63B 53/04

[52] U.S. Cl. ..... 473/326

[58] Field of Search ..... 273/170, 72 R, 273/72 A, 73; 473/324, 326, 332, 333

[56] References Cited

U.S. PATENT DOCUMENTS

| | | | |
|---|---|---|---|
| 2,592,013 | 4/1952 | Curley | 273/170 |
| 3,589,731 | 6/1971 | Chancellor | 273/170 |
| 4,461,481 | 7/1984 | Kim | 273/170 |
| 4,655,458 | 4/1987 | Lewandowski | 273/170 |
| 5,046,740 | 9/1991 | D'Eath | 273/170 |

FOREIGN PATENT DOCUMENTS

| | | | |
|---|---|---|---|
| 1056979 | 2/1967 | United Kingdom | 273/170 |

*Primary Examiner*—Mark S. Graham
*Attorney, Agent, or Firm*—Gregory J. Nelson

[57] ABSTRACT

A golf club having a head defining a recess which receives an insert containing a fluid such as mercury or an oil or silicon having metallic beads suspended therein. In a preferred embodiment, the insert has a conical projection and cover which define the fluid chamber and which define an annulus on the club head face.

10 Claims, 1 Drawing Sheet

GOLF CLUB

FIELD OF THE INVENTION

The present invention relates in general to an improved golf club and more specifically to a golf club head having a fluid-containing insert which enhances the effective area of the "sweet spot" and delivers greater impact to the ball when it is struck.

BACKGROUND OF THE INVENTION

Golf clubs are generally grouped by type into woods, irons and putters. Putters are used primarily for striking the ball in the green. Irons generally provide varying loft from wedges to a one iron and are normally used for playing the ball from short distances with a higher degree of loft to intermediate distances up to about 200 yards. Wood style golf clubs are generally used for longer distance driving of the golf ball and may be fabricated of wood or metals such as stainless steel, aluminum or various alloys. Clubs of this latter type are generally termed or referred to by golfers as "woods" notwithstanding the particular material from which they are fabricated.

When using woods, as indicated above, the object is to drive the golf ball long distances along a desired flight path, usually straight, although in some cases a slight fade or hook is desired. To achieve optimum distance, it is important to strike the ball squarely on the hitting area or "sweet spot" of the club with the greatest possible club head speed which the golfer can achieve. Achieving the proper golf club speed is a matter of technique which must be learned often by arduous practice. Providing a solid impact area can be improved by the club design and materials. As indicated above, many current golf club designs rely on the use of improved materials for club heads and shafts such as metal alloys to improve the ball impact velocity to achieve a longer ball flight path. It is known, for example, to vary the weight distribution to improve the impact. Typical of such designs are the well-known cavity and perimeter weighted club designs. It is also known to place metal plates in the face of wooden head clubs in the striking area to improve impact.

While these approaches have, to some degree, improved the golf club design and improved the ability of the user to strike the ball squarely, there nevertheless exists the need for improved golf clubs particularly of the wood type.

It is known that concentrating the mass in a wood style golf club at or behind the point of impact tends to increase the horizontal spin on the ball thus tending to cause hooks and slices. This is believed to be caused by the club striking the ball somewhat off center. When an offset impact occurs and mass is concentrated behind the "sweet spot", a force is exerted which tends to rotate the club shaft about its axis so that the face is not perpendicular to the desired flight path. This imparts a slice or hook to the ball depending on the direction of spin. When the club head mass is concentrated in the extremity of the golf club rather than behind the "sweet spot", the moment of inertia is increased and there is more resistance to the club head rotation upon impact of the ball.

Another approach is to utilize various metal alloys in order to achieve light weight. Many of these clubs are hollow. If metallic clubs are solid, they often become too heavy for practical use. However, hollow club heads tend to provide a tinny sound upon impact which does not appeal to some golfers. Furthermore, if the face of a hollow club is too thin, it may deform upon impact affecting the golf shot.

SUMMARY OF THE INVENTION

In view of the foregoing problems and shortcomings of current club designs, the present invention provides a golf club head which may be made of various materials and which includes an insert which enlarges the "sweet spot". The insert includes a face plate, preferably of metal, which is integral with or may be inset in the face of the club. A conical projection extends rearwardly from a face plate. A conical cap or cover encloses the conical projection so that a chamber is formed between the conical projection and the conical cap. The chamber defines an annulus on the rear of the face plate and the chamber is preferably filled with a fluid preferably having a high specific density, such as mercury or a viscous oil or silicon containing small metal balls. Upon impact, the fluid mass is centered behind the face plate in the area of the rearwardly extending conical projection and also in the annular band behind the club face. This construction is believed to add to the acceleration of the club and the impact delivered to the ball as the club increases the effective area of the "sweet spot". A ball not precisely struck with the club will nevertheless result in an acceptable shot, not having excessive fade or draw will also result.

BRIEF DESCRIPTION OF THE DRAWINGS

In view of the above and other objects and advantages of the present invention it will become more apparent upon review of the following detailed description of the invention below taken together with the drawings in which.

DETAILED DESCRIPTION OF THE PREFERRED EMBODIMENT OF THE INVENTION

Figure 1:
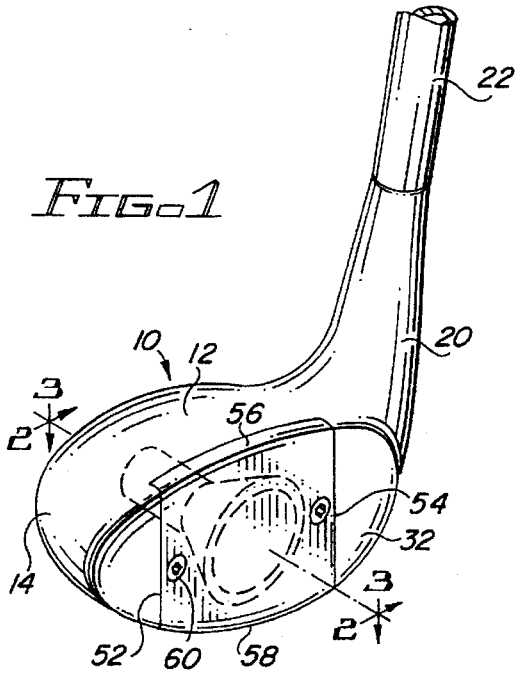
FIG. 1 is a perspective view of the head and a portion of a shaft of a golf club according to the present invention as viewed from the face of the club.

For convenience, the same reference numerals are used to identify the same or identical components throughout the various drawing figures.

Turning first to FIG. 1, a golf club according to the present invention is shown and is generally designated by the numeral 10. The club has a head 12 which has a top surface 14 and a sole 16 which curves rearwardly to a rear surface 18. A hosel 20 is integrally formed with the head and, as is conventional, provides a location for attachment of shaft 22. The shaft 22 may be of any conventional material such as steel, graphite, titanium or other of the more exotic materials currently used in golf club shaft construction. The golf club head 12 defines an internal cavity 30 which extends to the front face 32 of the club. Club head 12 may be constructed of any suitable material such as wood, metal or even plastic.

Figure 4:
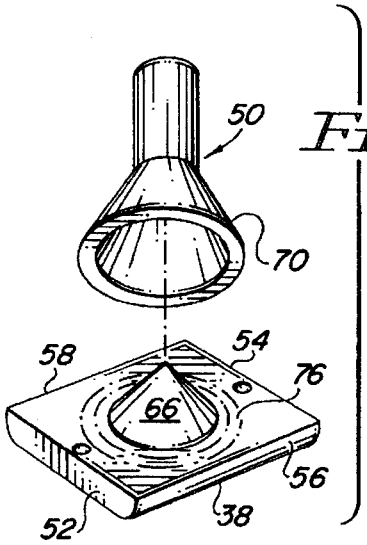
FIG. 4 is an exploded perspective view showing the face plate and cap components of the golf club head.
Figure 3:
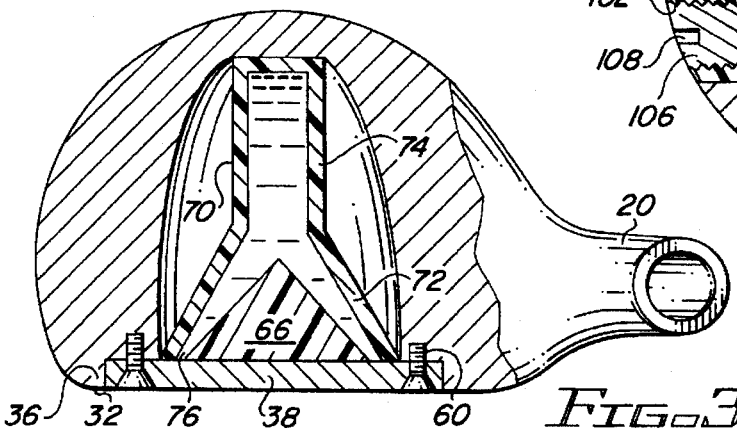
FIG. 3 is a sectional view taken along line 3—3 of FIG. 1.

As best seen in FIG. 3, the face 32 of the club is provided with a recess 36 which receives the face plate 38 of the impact-enhancing insert 50. The components of the insert are best seen in FIG. 4 and include the face plate 38 which is shown as having opposite sides 52 and 54 and upper and lower edges 56 and 58 which conform to the contour of the upper and lower surfaces of the club head. The insert may be plastic, but is preferably metal and is secured to the head of the club at recess 36 by a pair recessed fasteners 60 shown as screws.

Extending rearwardly from the rear surface of face plate 38 is a projection 66 which is shown as being conical and centrally positioned with respect to the face plate 38. Projection 66 may be integrally formed as part of the face plate or may be a metal or plastic component secured to the rear surface of the face plate by a suitable adhesive or by other joining methods such as welding or soldering.

The diameter of the base of the projection 66 may vary depending upon the size of the face plate and the size of the club but typically would be in the range of approximately 2 to 4 centimeters depending on the club head size. The projection extends rearwardly within cavity 30 a depth corresponding approximately one-fourth to one-third of the front-to-rear club dimension. A cap 70 also extends rearwardly from the face plate 38 and has a conical wall 72 spaced from conical projection 66. The cap 72 may also include a integrally formed rearwardly extending cylindrical section 74. The cap defines an internal chamber 75 with the projection 66. The chamber 75 is annular at 76 at the rear edge of the face plate which annular area projected on the rear of the face place being shown in phantom lines in FIG. 4. The chamber 75 is filled with a fluid 80, preferably a fluid having a high specific gravity such as mercury. The chamber may be completely filled or partially filled with fluid. However, PGA rules regarding design of golf clubs do not permit a moveable element within the head of a golf club so that by completely filling the chamber, it is believed the club will comply with PGA requirements. The fluid acts in the annular area 76 and also behind the conical projection 66 to effectively increase the sweet spot and also concentrate the mass of the club at the location where the ball is normally struck. This design should also reduce the tendency of a club to rotate or twist when the ball impact point is offset from the center of the club area defined by the annulus 76.

The present design also helps to avoid the tinny or metallic pinging sound which is associated with many metal woods and which some golfers find objectionable. By locating the insert assembly 50 within a cavity 30 in the club head, overall club head weight can be reduced and yet provide substantial mass in the ball striking area.

While mercury is the preferred fluid because of its density, in some cases it may be desirable to use other fluids such as a viscous, highly refined oil, a silicon gel, or glycerin containing small metallic balls. The balls or beads are similar to b-b shot, and may be steel, brass, copper, lead or similar material. The metallic balls or shots will flow with the fluid or within the fluid. However, it is noted that the fluid is sealed within an enclosed chamber and leakage should not occur through normal use of the club.

Figure 5:
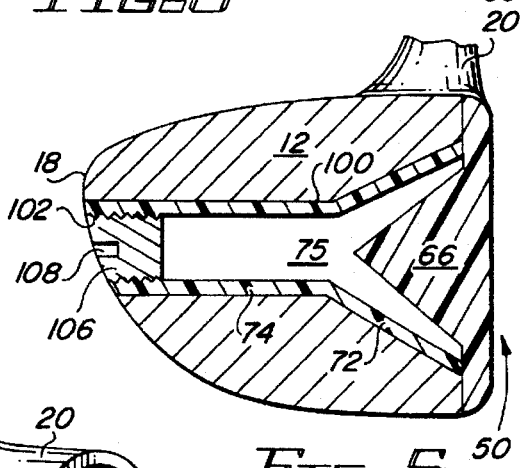
FIG. 5 is a cross-sectional view similar to FIG. 2 showing an alternate embodiment of the present invention in which the volume of the fluid-containing chamber may be accessed by a threaded plug in the rear of the club head.

FIG. 5 shows an alternate embodiment of the present invention in which a golf club head 12 is connected to a hosel 20. The interior of the club is bored at 100 to receive the insert assembly 50. The insert assembly 50 is generally as described with reference to previous figures having a generally planar base plate 38, the rear surface of which is provided with a rearwardly extending conical projection 66. A cap 70 having a conical portion 72 and a rearwardly extending cylindrical section 74 define an internal chamber which receives a suitable viscous, high density fluid. In the embodiment of FIG. 5, the conical portion 74 of the insert 50 extends rearwardly to the rear surface 18 of the golf club head. The inner surface of the cylindrical section 74 is threaded at 102 and receives a plug 106 which may be conveniently rotated by means of notch 108. The outer surface of the plug is curved at 110 to generally conform to the rear surface 18 of the golf club. Access to the chamber 75 is accomplished by removing plug 106. Generally chamber 75 will contain approximately 12 to 15 grams of fluid. The amount of the fluid can be varied since the user has convenient access to the chamber 75. Also, the total volume of the chamber can be adjusted to some extent by turning the plug to move it in a direction towards the face plate.

Figure 6:
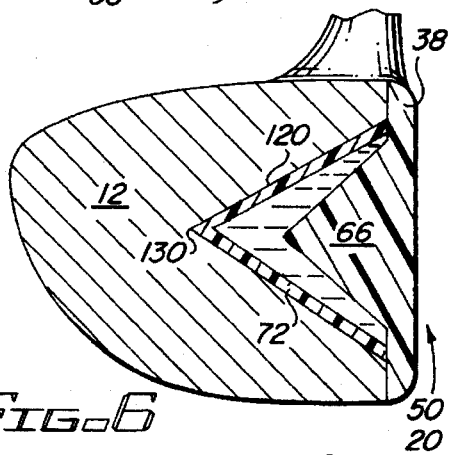
FIG. 6 is a cross-sectional view of still another embodiment of the golf club of the present invention.
Figure 2:
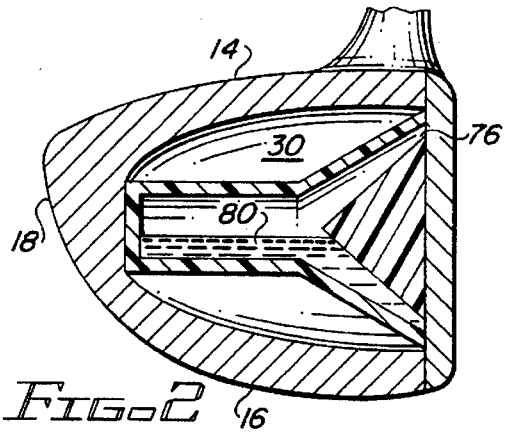
FIG. 2 is a sectional view taken along line 2—2 of FIG. 1.

In FIG. 6, the golf club head 12 is again shown having a recess 120 which is generally conical shape. The insert 50 has a face plate 38 with a rearwardly extending projection 66. A cap has a generally conical wall 72 which terminates at apex 130 defining a chamber 75 in the area between the cap and the projection 66. The chamber is filled with a suitable fluid such as mercury or other fluids and metallic shot as described above. In the embodiment FIG. 6, the area of the chamber 75 would be generally smaller and is shown with respect to previous embodiments. The insert can be made as an integral unit and is inserted in the club face.

While the invention has been particularly shown and described with reference to several preferred embodiments, it will be understood by those skilled in the art that various other modifications and changes may be made to the present invention utilizing the principles of the invention as herein described without departing from the spirit and scope of the invention as defined and encompassed in the accompanying claims.

I claim:

1. In a golf club having a club head and an attached shaft, the club head having a rear and a face, a sole and a top, the improvement comprising:

(a) a projection extending rearwardly from the club face within a recess in the club head;

(b) a cap extending about said projection and defining an annular chamber area with said projection rearwardly of the face; and (c) a fluid in said annular chamber, said fluid is a fluid having a high specific gravity.

2. The golf club of claim 1 wherein said fluid is mercury.

3. The golf club of claim 1 wherein said fluid is a viscous oil.

4. The golf club of claim 1 wherein said fluid contains a plurality of metallic beads.

5. The golf club of claim 1 wherein said club face includes a face plate which with said projection and cap form an integral insert positionable in said recess in said club head.

6. The golf club of claim 1 wherein said cap includes a rearwardly extending section and wherein said section has a removable plug located at the rear of the club head.

7. The golf club of claim 1 wherein said recess defines a generally hollow club head interior.

8. The golf club of claim 1 wherein said club head is metal.

9. The golf club of claim 1 wherein said club head is wooden.

10. The golf club of claim 1 wherein said projection and cap are generally conical.

* * * * *